US010123643B2

(12) United States Patent
Davis

(10) Patent No.: US 10,123,643 B2
(45) Date of Patent: Nov. 13, 2018

(54) LAPEL SUPPORT

(71) Applicant: Lisa A. Davis, Glendale, CA (US)

(72) Inventor: Lisa A. Davis, Glendale, CA (US)

( * ) Notice: Subject to any disclaimer, the term of this patent is extended or adjusted under 35 U.S.C. 154(b) by 25 days.

(21) Appl. No.: 15/265,616

(22) Filed: Sep. 14, 2016

(65) Prior Publication Data

US 2017/0071263 A1 Mar. 16, 2017

Related U.S. Application Data

(60) Provisional application No. 62/218,537, filed on Sep. 14, 2015.

(51) Int. Cl.
*A47G 25/00* (2006.01)
*A47G 25/20* (2006.01)

(52) U.S. Cl.
CPC ..... *A47G 25/00* (2013.01); *A47G 25/20* (2013.01)

(58) Field of Classification Search
CPC .... A41B 3/00; A41B 3/06; A41B 3/02; A41B 3/04; A41B 3/08; A47G 25/00; A47G 25/20; A47G 25/28; A47G 25/30
See application file for complete search history.

(56) References Cited

U.S. PATENT DOCUMENTS 709,909 A 9/1902 Jenkins
732,532 A 6/1903 Fallek
1,128,635 A 2/1915 Taylor et al.
1,237,347 A * 8/1917 Lopoti ..... A47G 25/486 223/93
1,355,798 A 10/1920 Zhukoff
1,381,733 A 6/1921 O'Connor
1,547,951 A 7/1925 Olson
1,814,653 A 7/1931 Wilson
1,872,260 A * 8/1932 Elzey ..... B65D 85/182 223/83
1,886,826 A 11/1932 Mead
1,897,090 A 2/1933 Walding
1,941,699 A 1/1934 Loffler
1,985,523 A 12/1934 Singleton et al.
2,004,288 A 6/1935 Krick
2,022,401 A 11/1935 Brooks et al.
2,038,179 A 4/1936 Joyce
2,133,068 A 10/1938 Wiegman
2,147,519 A 2/1939 Brownfield
2,171,301 A 8/1939 Christensen et al.
2,204,004 A 6/1940 Steele
(Continued)

FOREIGN PATENT DOCUMENTS

JP H1067413 A 3/1998
JP H11255280 A 9/1999
(Continued)

*Primary Examiner* — Ismael Izaguirre
(74) *Attorney, Agent, or Firm* — Jeffrey G. Sheldon; Katherine B. Sales; Cislo & Thomas LLP

(57) ABSTRACT

A lapel support comprises a grip, a loop and a coupling member. The lapel support is for use on a garment that is being supported by a hanger. The hanger comprises a clothes support structure and a rod for suspending the clothes support structure from a rod, for example in a closet. The grip grips the rod of the hanger and is coupled to the coupling member. The coupling member is also coupled to the loop, and maintains tension between the grip and the loop. The loop engages a button on a garment.

12 Claims, 4 Drawing Sheets

(56) References Cited

U.S. PATENT DOCUMENTS

| | | | | |
|---|---|---|---|---|
| 2,244,167 | A | 6/1941 | McGee | |
| 2,322,672 | A | 6/1943 | Steele | |
| 2,331,625 | A | 10/1943 | Patch | |
| 2,368,724 | A | 2/1945 | Patch | |
| 2,468,477 | A | 4/1949 | Zimmerman | |
| 2,569,152 | A | 9/1951 | Collins | |
| 2,586,909 | A | 2/1952 | Blackman | |
| 2,630,949 | A | 3/1953 | Steele | |
| 2,688,137 | A | 9/1954 | Costa | |
| 2,770,405 | A | 11/1956 | Williams | |
| 2,784,886 | A | 3/1957 | Iverson | |
| 2,845,670 | A | 8/1958 | Brown et al. | |
| 2,861,726 | A | 11/1958 | Whyte | |
| 2,891,707 | A | 6/1959 | Shrom | |
| 2,967,647 | A | 1/1961 | Billingsley | |
| 2,973,887 | A | 3/1961 | Bonaldi | |
| 2,999,619 | A | 9/1961 | Thorne | |
| 3,007,615 | A | 11/1961 | Goush et al. | |
| 3,038,165 | A | 6/1962 | Gross | |
| 3,045,881 | A | 7/1962 | Lilya | |
| 3,072,306 | A | 1/1963 | Macrides | |
| 3,085,725 | A | 4/1963 | Caparosa | |
| 3,184,127 | A | 5/1965 | Smith | |
| 3,381,865 | A * | 5/1968 | Pehr | A47G 21/165 2/145 |
| 3,474,503 | A | 10/1969 | Less | |
| 3,865,286 | A | 2/1975 | Tiss | |
| 4,000,522 | A | 1/1977 | Swanson | |
| 30,701 | A | 8/1981 | Williams et al. | |
| 4,827,576 | A | 5/1989 | Prince, Jr. | |
| 5,337,457 | A | 8/1994 | Chennault | |
| 5,360,148 | A | 11/1994 | Goscin et al. | |
| 5,361,516 | A | 11/1994 | Dahman | |
| 5,551,126 | A * | 9/1996 | Wallo | A45F 5/02 24/3.3 |
| 5,555,648 | A * | 9/1996 | Griffin | D06F 59/02 223/67 |
| 5,605,261 | A | 2/1997 | Berglund | |
| 5,613,628 | A | 3/1997 | Burkhalter | |
| 5,769,287 | A | 6/1998 | Kim | |
| 5,769,288 | A | 6/1998 | Berglund | |
| 5,903,928 | A | 5/1999 | Hyung-Seob | |
| 6,389,659 | B1 | 5/2002 | Jacobs | |
| 6,748,602 | B1 | 6/2004 | Barnes | |
| 6,889,387 | B1 | 5/2005 | Tiss et al. | |
| 7,058,988 | B1 | 6/2006 | Zahner | |
| 7,305,996 | B2 | 12/2007 | Kraft et al. | |
| 7,328,821 | B2 | 2/2008 | Dedo | |
| 7,392,920 | B2 | 7/2008 | Dedo | |
| 7,487,574 | B2 | 2/2009 | Lee-Holowka et al. | |
| 7,748,581 | B2 | 7/2010 | Yamada | |
| 8,001,619 | B1 | 8/2011 | Baehring | |
| 8,261,370 | B2 | 9/2012 | Elahi et al. | |
| 8,678,250 | B2 | 3/2014 | Williams | |
| 8,813,254 | B2 | 8/2014 | Boos | |
| 8,925,770 | B1 | 1/2015 | Garcia | |
| 8,950,014 | B2 | 2/2015 | Schottenstein | |
| 9,119,430 | B1 | 9/2015 | Fisher | |
| 9,433,312 | B2 * | 9/2016 | Cooper | A47G 25/48 |
| 2003/0209576 | A1 | 11/2003 | Silbert | |
| 2007/0261975 | A1 | 11/2007 | Rabinoff | |
| 2007/0295769 | A1 | 12/2007 | Burroughs | |
| 2008/0040903 | A1 | 2/2008 | Dedo | |
| 2008/0105716 | A1 | 5/2008 | Schulkin | |
| 2009/0038049 | A1 | 2/2009 | West | |
| 2009/0144879 | A1 | 6/2009 | Newberry | |
| 2011/0173740 | A1 | 7/2011 | Franklin | |

FOREIGN PATENT DOCUMENTS

| | | | |
|---|---|---|---|
| JP | 2000109154 | A | 4/2000 |
| JP | 2000296295 | A | 10/2000 |
| JP | 2001246195 | A | 9/2001 |
| JP | 2006087787 | A | 4/2006 |
| JP | 2007084132 | A | 4/2007 |

* cited by examiner

LAPEL SUPPORT

CROSS-REFERENCE TO RELATED APPLICATIONS

The present Application claims the benefit of U.S. Provisional Patent Application No. 62/218,537 entitled "Lapel Support," filed Sep. 14, 2015, the contents of which are incorporated in this disclosure by reference in their entirety.

BACKGROUND

Many people have the desire for straight, unwrinkled lapels on their shirts. Currently, when a shirt is hanging on a hanger, the lapels ripple and do not lie straight, thus even freshly washed shirts will have wrinkled lapels. It is important to have unwrinkled lapels when a person desires a polished, professional appearance. If the lapels ripple or are wrinkled, the person is not achieving the desired appearance. Consequently, there is a need for an improved lapel support, which prevents crinkling, rippling and wrinkling of the lapels of a shirt.

The present invention overcomes several of the deficiencies, disadvantages and undesired parameters associated with the known lapel supports.

SUMMARY

An object of the present invention is to provide a system comprising a hanger, wherein the hanger comprises a clothes support structure and a rod suspending the clothes support structure, a garment supported by the hanger, the garment having a lapel and a button, and a lapel support, the lapel support comprising a grip gripping the rod, a loop engaging the button, and a coupling member coupled to the grip and the button and providing tension between the grip and the loop for preventing wrinkles in the garment. In one aspect of the present invention, the garment button is an upper button.

Another object of the present invention is to provide a lapel support for a garment on a hanger, wherein the hanger comprises a clothes support structure and a rod for suspending the clothes support structure, the lapel support comprising a grip for gripping the rod, a loop for engaging a button on the garment, and a coupling member for providing tension between the grip and the loop. In one aspect of the present invention, the coupling member comprises an upper portion and a lower portion. In another aspect of the present invention, the grip comprises the upper portion of the coupling member. In another aspect of the present invention, the coupling member is elastic. In another aspect of the present invention, the coupling member is not elastic and is adjustable. In yet another aspect of the present invention, the grip is a closed loop. In another aspect of the present invention, the grip is in the shape of a hook. In still another aspect of the present invention, the loop is in the shape of a lock.

Another object of the present invention provides a method of using the lapel support, wherein the method comprises the steps of a) providing a hanger comprising a clothes support structure and a rod suspending the clothes support structure, b) supporting a garment on the hanger, the garment having a lapel and a button, c) engaging the button with the loop, and d) gripping the rod with the grip, wherein the coupling member provides tension between the grip and the loop for preventing wrinkles in the garment. In one aspect of the present invention, step d) is performed before step c).

In another aspect of the present invention, the lapel support is used in combination with the hanger.

DRAWINGS

These and other features, aspects and advantages of the present invention will become better understood with regard to the following description, appended claims and accompanying figures where:

DESCRIPTION

As used herein, the following terms and variations thereof have the meanings given below, unless a different meaning is clearly intended by the contest in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

The term "lapel" refers to the part on each side of a shirt, coat or jacket immediately below the collar.

The term "grip" refers to a part of a device for securing the device to a hanger rod.

The term "elastic" refers to a part of a device that is able to return to its normal shape spontaneously after contraction, dilation or distortion.

Figure 1:
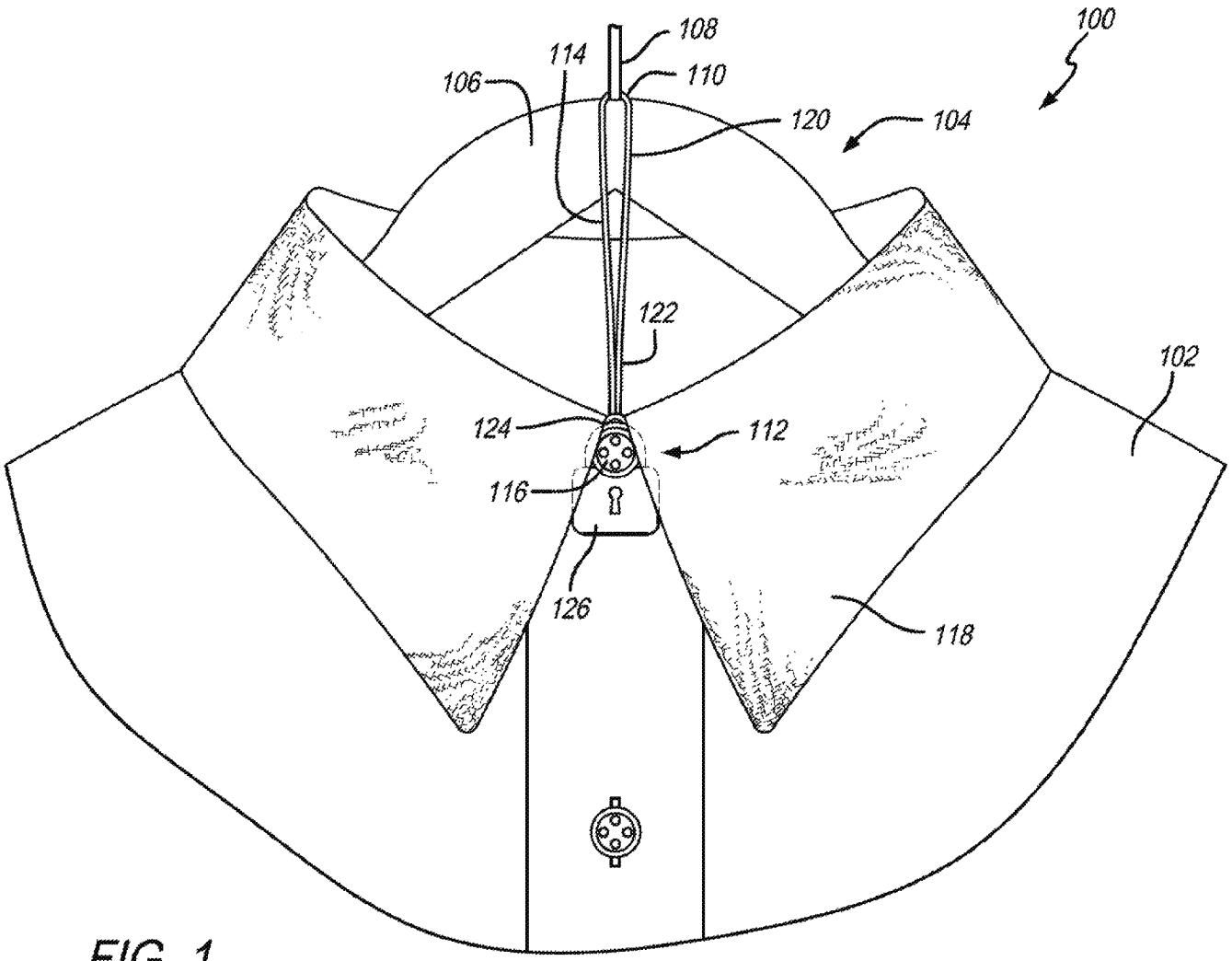
FIG. 1 is a perspective view of a system according to the present invention.
Figure 2:
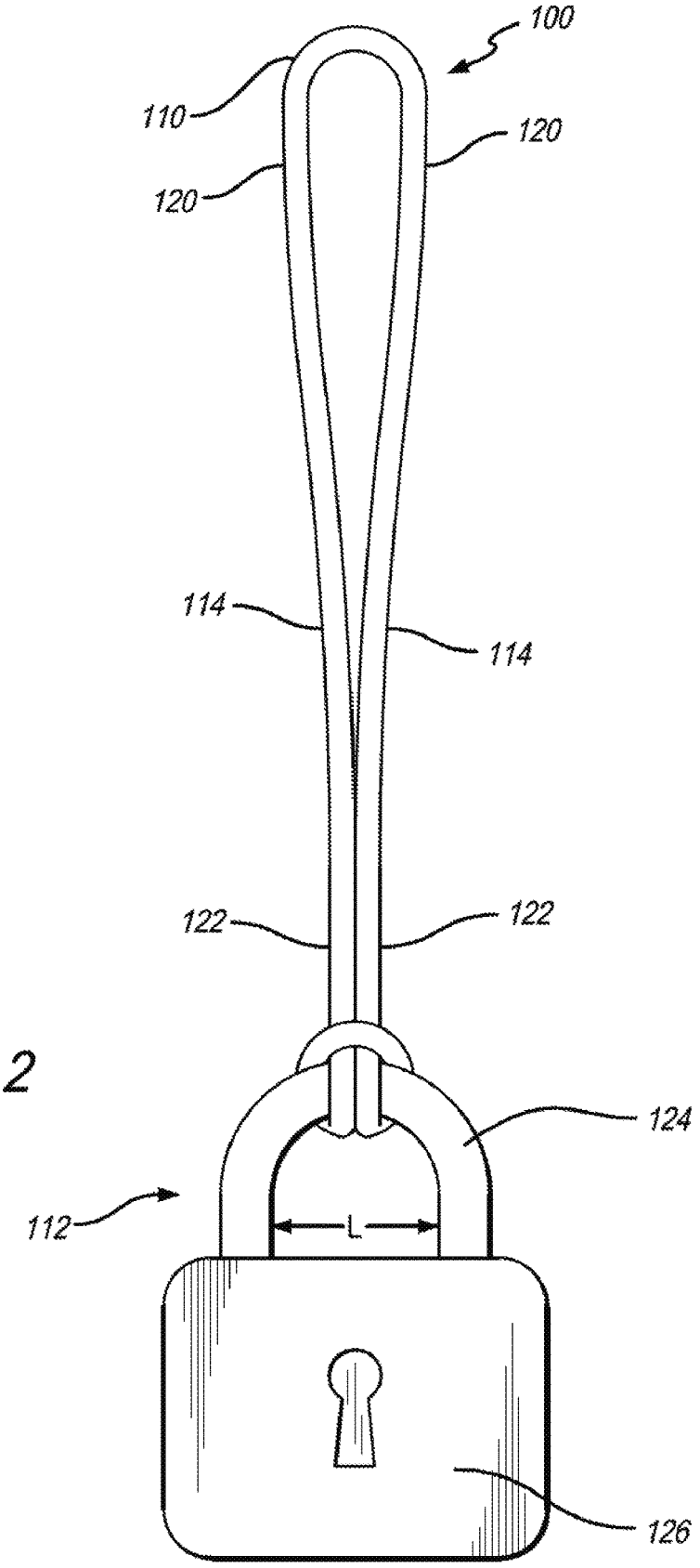
FIG. 2 is a front elevation view of a lapel support of the system of FIG. 1.
Figure 3:
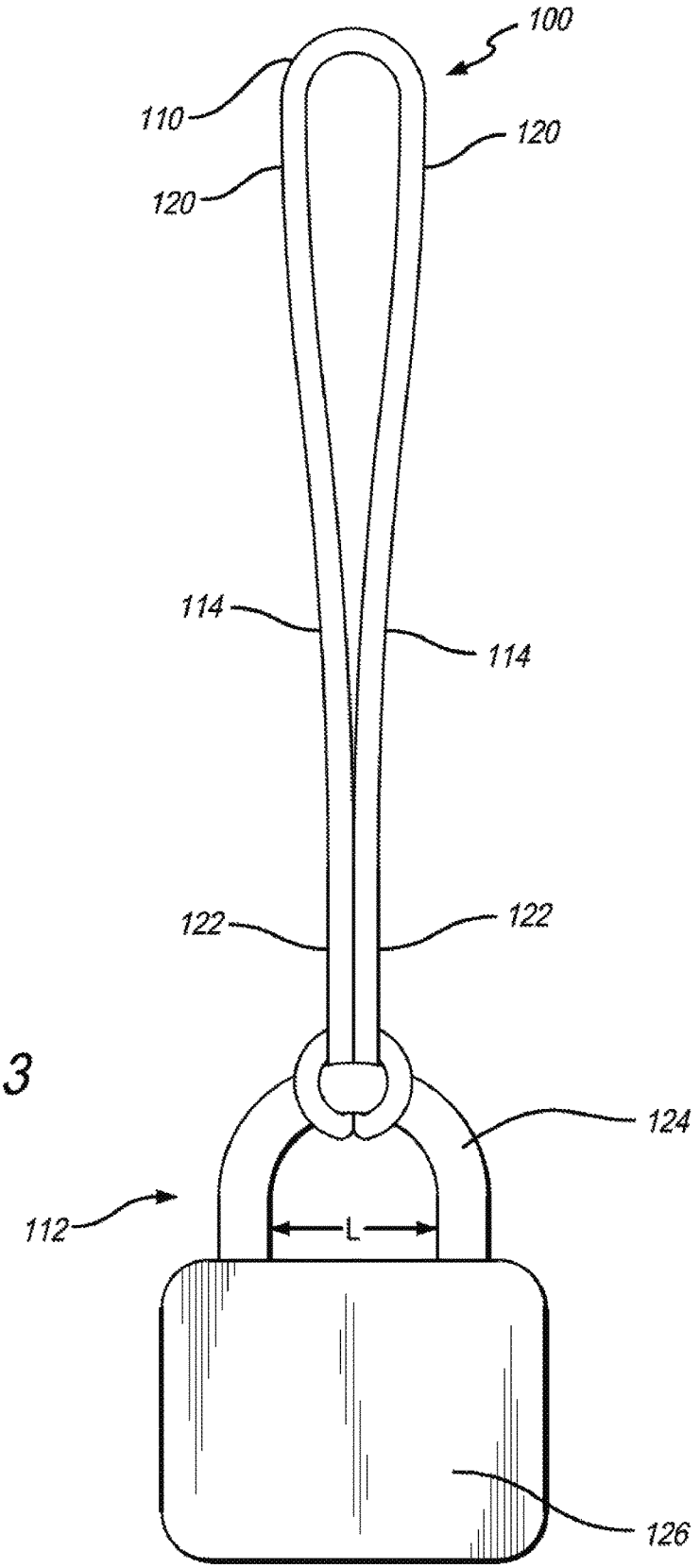
FIG. 3 is a rear elevation view of the lapel support according to FIG. 2.

Referring now to FIGS. 1-3, there is shown a lapel support 100 that is used for a garment 102 that is being supported by a hanger 104. The hanger 104 comprises a clothes support structure 106 and a rod 108 for suspending the clothes support structure 106 from a rod (not shown), for example, in a closet. The lapel support 100 comprises a grip 110, a loop 112 and a coupling member 114. The grip 110 grips the rod 108 of the hanger 104 and is coupled to the coupling member 114. The coupling member 114 is also coupled to the loop 112, and maintains tension between the grip 110 and the loop 112 when in place. The loop 112 engages a button 116 on the garment 102. The button 116 can be any button located on the garment 102. Preferably the button 116 is located on the upper portion of the garment 102, but it is not necessary that the engaged button be the top most button on the garment 102. Tension provided by the coupling member 114 causes lapels 118 of the garment 102 to remain straight and unwrinkled while the garment 102 is hanging on the hanger 104.

The coupling member 114 can be made of any material, including but not limited to plastic, metal, wood or rubber. Preferably the coupling member 114 is made of rubber so that it is elastic. The advantage of an elastic coupling member 114 is that it allows tension to be maintained between the grip 110 and the loop 112 without the user having to adjust the length of the coupling member 114, thus constantly maintaining tension on the button 116 of the garment 102 without any adjustment by the user. The coupling member 114 provides enough tension to keep the lapels 118 of the garment 102 from rippling or wrinkling, but not too much tension that it pulls the button 116 up and distorts the garment 102.

The coupling member 114 has an upper portion 120 and a lower portion 122. The upper portion 120 is proximate to the rod 108 of the hanger 104 and the lower portion 122 is proximate to the button 116 on the garment 102.

Figure 4:
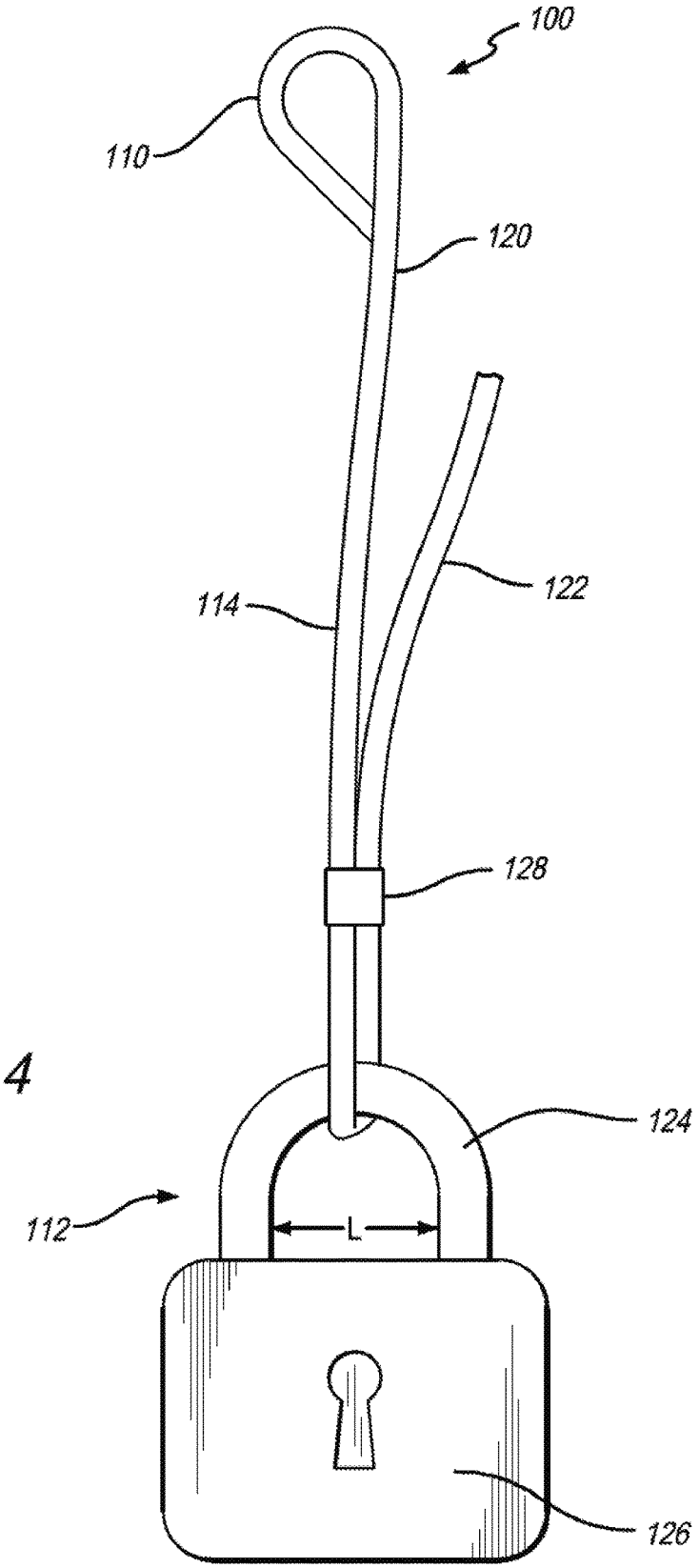
FIG. 4 is a front elevation view of another version of a lapel support.

Optionally, as shown in FIG. 4, the coupling member 114 can comprise a single length of material coupled to the grip 110 and the loop 112.

Because shirts and garments come in an endless amount of different styles and sizes, their buttons are in different locations with respect to the rod 108 of the hanger 104. As such, the coupling member 114 can be any length so that the lapel support 100 can be used on any size and style of shirt or garment 102. When not under tension, the elastic coupling member 114 can be approximately 1 inch to 12 inches in length.

Optionally, the coupling member 114 can be made of a non-elastic material where the length of the non-elastic material is adjustable. This allows the coupling member 114 to maintain tension between the rod 108 and the button 116 by adjusting the length of the coupling member 114 to the desired setting.

As shown in FIG. 4 in another version of the invention, the coupling member 114 comprises a restraint 128 coupled to the coupling member 114, allowing the coupling member 114 to be adjusted to the desired length and then restrained at the desired length. The restraint 128 can comprise a clamp which clamps the lower portion 122 of the coupling member back onto the coupling member 114 at the desired location to keep the coupling member 114 at the desired length. Having a coupling member 114 that is adjustable is very beneficial. The locations of buttons on shirts can vary greatly, depending on the style of the shirt as well as whether it is designed for men or women. With an adjustable coupling member 114, the user is able to adjust the lapel support 100 accordingly to accommodate an endless variety of different styles and sizes of shirts. The restraint 128 can be used on both an elastic and a non-elastic coupling member 114.

The grip 110 can be made of any material, including but not limited to plastic, metal, wood or rubber. The grip 110 can be any shape and any size necessary to grip the rod 108 of the hanger 104. Optionally, as shown in FIG. 4 the grip 110 can be in the shape of a loop, where the loop can be placed over and around the rod 108 of the hanger 104. Additionally, the grip 110 can be in the shape of a hook, where the hook can be hooked around the rod 108 of the hanger 104. The grip 110 can also be in the shape of one or more lengths of material that are tied or knotted to or around the rod 108 of the hanger 104. Preferably, as shown in FIGS. 1-3, the grip 110 is the upper portion 120 of the coupling member 114.

The loop 112 can be made of any material, including but not limited to plastic, metal, wood or rubber. The loop 112 engages a button 116 on the garment 102, and once the button 116 is engaged, the coupling member 114 is able to create tension between the rod 108 and the button 116. This tension keeps the lapels 118 straight. The loop 112 preferably is sufficiently large to engage the button 116, but not so large as to slip off the button 116. The minimum dimension L across the loop 112 is about 0.25 inches and the maximum dimension L across the loop 112 is about 4 inches. Preferably the dimension L across the loop 112 is about 0.5 inches to about 1 inch.

The loop 112 can be any shape and does not need not be circular nor does it need to be a closed loop. For example, the loop 112 can be in the shape of a circle, oval, rectangle, square, triangle, hook, etc. The loop 112 can be any shape as long as it can engage a button 116 on the garment 102.

Optionally, the loop 112 can be made from a material designed to discourage insects from consuming the garment 102. One example is cedar, which provides the added benefit of discouraging moths from consuming the garment 102. Additionally, the loop 112 can be made from a material infused with a desired scent, to provide fragrance and freshness to the garment 102 that the lapel support 100 is being used on.

One embodiment, as shown in FIGS. 1-3, comprises a grip 110, a coupling member 114, and a loop 112 in the shape of a lock formed by a curved shackle member 124 attached to a lock body 126, creating a space between the curved shackle member 124 and the lock body 126. The button 116 on the garment 102 fits into the space created by the curved shackle member 124 and the lock body 126, thus allowing the lock-shaped loop 112 to engage the button 116. Once the button 116 is engaged by the lock-shaped loop 112 and the grip 110 grips the rod 108 of the hanger 104, the coupling member 114 maintains tension between the lock-shaped loop 112 and the grip 110, thus preventing rippling and wrinkling of the lapels 118 of the garment 102.

A method of using the lapel support 100 comprises the steps of a) providing a hanger 104 comprising a clothes support structure 106 and a rod 108 suspending the clothes support structure 106; b) supporting a garment 102 on the hanger 104, the garment 102 having a lapel 118 and a button 116; c) engaging the button 116 with the loop 112; and d) gripping the rod 108 with the grip 110, wherein the coupling member 114 provides tension between the grip 110 and the loop 112 for preventing wrinkles in the garment 102. Optionally, step d) can be performed before step c).

Thus the lapel support 100 solves the problem of garments having wrinkled lapels when hanging on a hanger. It also has the advantages of being attractive, easy to use, and it accommodates any size and style of garment.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference in their entirety.

What is claimed is:

1. A system comprising:

a) a hanger comprising a clothes support structure and a rod suspending the clothes support structure;

b) a garment supported by the hanger, the garment having a lapel and a button; and c) an apparatus for preventing lapel wrinkles comprising:

i) a grip for removable placement around the rod for gripping the rod;

ii) a loop removably engaging the button on the garment for removable attachment to the button; and iii) an elastic coupling member coupled to the grip and the loop and providing tension between the grip and the loop for preventing lapel wrinkles.

2. The system of claim 1, wherein the button is an upper button.

3. An apparatus for preventing lapel wrinkles for a garment on a hanger, the hanger comprising a clothes support structure and a rod for suspending the clothes support structure, the apparatus comprising:

a) a grip for removable placement around the rod for gripping the rod;

b) a loop for engaging a button on the garment; and c) an elastic coupling member providing tension directly from the loop to the grip.

4. The apparatus of claim 3, wherein the coupling member comprises an upper portion and a lower portion.

5. The apparatus of claim 4, wherein the grip comprises the upper portion of the coupling member.

6. The apparatus of claim 3, wherein the coupling member is not elastic and is adjustable.

7. The apparatus of claim 3, wherein the grip is a closed loop.

8. The apparatus of claim 3, wherein the grip is in the shape of a hook.

9. The apparatus of claim 3, wherein the loop is in the shape of a lock.

10. A method of using the apparatus of claim 3, the method comprising the steps of:

a) providing a hanger comprising a clothes support structure and a rod suspending the clothes support structure;

b) supporting a garment on the hanger, the garment having a lapel and a button;

c) engaging the button with the loop; and d) gripping the rod with the grip, wherein the coupling member provides tension between the grip and the loop for preventing wrinkles in the garment.

11. The method of claim 10, wherein step d) is performed before step c).

12. The apparatus of claim 3 in combination with the hanger.

* * * * *